United States Patent [19]

Ivany

[11] 3,968,615

[45] July 13, 1976

[54] METHOD, BUILDING STRUCTURE AND BLOCK THEREFOR

[76] Inventor: George R. Ivany, 3871 W. Valley Drive, Faiview Park, Ohio 44126

[22] Filed: Aug. 15, 1975

[21] Appl. No.: 605,021

[52] U.S. Cl. ..... 52/439; 52/259; 52/595

[51] Int. Cl.[2] ..... E04B 2/18

[58] Field of Search ..... 52/439, 259, 284–286, 52/, 503, 505, 589–595, 603–605, 566, 421

[56] References Cited

UNITED STATES PATENTS

| | | | |
|---|---|---|---|
| 2,684,589 | 7/1954 | Perreton | 52/439 X |
| 3,222,830 | 12/1965 | Ivany | 52/259 X |
| 3,717,967 | 2/1973 | Wood | 52/439 |
| 3,888,060 | 6/1975 | Haener | 52/594 X |

FOREIGN PATENTS OR APPLICATIONS

| | | | |
|---|---|---|---|
| 841,339 | 6/1952 | Germany | 52/595 |

*Primary Examiner*—J. Karl Bell
*Attorney, Agent, or Firm*—P. D. Golrick

[57] ABSTRACT

A three-cavity, horizontal-beam-forming building block, or distribution block, with two-fold rotational symmetry about a vertical center line, has the opposite ends of each longitudinal sidewall complementarily tongued and grooved, and four like transverse webs extending above the sidewall top coplanar margins in end-beveled projections; a web face spacing (of 1:4:2:4:1) defining a slot-like narrow middle cavity, adjacent thereto, equal larger bottom-closed cavities as cells of twice slot size, and end recesses of half-slot size; and like horizontal-reinforcing-bar-locating, paired bar notches in each web top to a depth below the sidewall top margins enabling horizontal bar embedment by mortar filled to the sidewall tops.

In laying up building walls with staggered courses of similar blocks lacking closed bottoms and bar notches, and periodically a course of distribution blocks, only the bed joints between courses, and not the head joints between successively adjacent blocks in a course, are mortared, speeding up the laying, but as each floor or other appropriate vertical interval is completed with a reinforced beam block course, the narrow vertical slot spaces with vertical bars, arising from aligned alternating full slots and slots formed by adjacent half-slots of abutting blocks, and also the bottom -closed cavities or pockets of the beam blocks, are filled with grout or mortar to afford head joint bonding in vertical mortar columns and also to form horizontal beams.

9 Claims, 7 Drawing Figures

METHOD, BUILDING STRUCTURE AND BLOCK THEREFOR

In current building construction and design, molded or cast hollow blocks of cement or concrete and similar compositions yet have numerous and extensive applications.

Construction of building walls, above or below grade, with blocks of this type possesses the advantages, among others, that extensive formwork is not required; reinforcing steel is readily introduced and supported; work can advance vertically more rapidly without long waiting for curing; certain flexibility of design is available with structural variations more easily made; and in some cases, because the residual hollow spaces or cavities afford a useful degree of thermal and/or sound insulation and of lightness as compared, for example, with solid poured concrete.

However, considerable manual labor by masons or bricklayers is entailed, not only in placing and setting the blocks, with mortar application along the top of each finished course for the horizontal or "bed" joints to blocks in the succeeding course, but also, and especially time and mortar consuming, in applying mortar to the end of blocks for the vertical joints or "head" joints between successive blocks in a course; and where used, in the emplacement of steel reinforcing rods.

Consequently any aspect of block wall construction and of block structure which facilitates laying up a block wall by expediting appropriate setting of the blocks, mortar application, and steel reinforcing emplacements or which minimizes materials used, represents advantage in advancing the economics as well as structural utility of block wall construction, and of blocks used therefor.

For this reason the prior art has proposed wall constructions and hollow block-modules, which aid the location of the blocks one with another within a course or between courses (See U.S. Pat. Nos. 2,736,188 to Wilhelm; 2,205,419 to Kraemer; 2,176,986 to Briscoe; 2,019,653 to Buyer; 1,503,931 to Wightman), or for aiding location and support of reinforcing rods either horizontally or vertically, or both (See U.S. Pat. Nos. 3,222,830 to Ivany; 3,717,967 to Wood; also Malinovszky 2,118,936).

By the present invention there is provided an improved structure in block modules of the character described, and in the construction of building walls wherein modules are used. Though other particular advantages are afforded for attainment of smooth wall faces with close tight joints, or for ease or flexibility of reinforcing emplacement, of particular importance is a proportioning of the spacing of transverse webs joining the longitudinal block walls to form three vertical cavities — namely, a narrow central "slot" and on each side thereof respective large "cells" - and end recess or "half-slots ", each half the width of the central slot, taken in conjunction with complementary vertical tonguing and grooving in the ends of the longitudinal side walls, and also uniform top projections of the webs.

The terms "wall cells", "wall cell space", "wall slot" or "wall slot space" are hereinafter used to signify the vertically elongated voids or channels corresponding to the cells and slots, (slots including resulant slots of endwise block dispositions), arising from the laying up of the blocks in courses which are staggered, that is, offset to shift the vertical joints of each course, hence the "resultant" slots, over the full slots of blocks in the course below. By the term "molded hollow concrete block" is to be understood in reference to a block of the invention, a block of concrete or similar material, made in appropriate forms to give the desired shape, whether the fabrication operation be termed molding or casting; and "hollow" in the sense of having vertical through cavities open at the top and bottom of the block.

By these features of the blocks as well as wall building modules, as the blocks of each course are laid successively end to end, no mortar is applied to form head joints, but the tongues and grooves are interfitted, automatically aiding alignment in the course and forming between each endwise abutting pair of blocks a full slot of the same size as a central slot in the staggered courses above and below. Thus as each course is laid upon another the horizontal or bed joint mortar is quickly applied only along the tops edges of the block side walls of the course below; and as each block is placed staggered relative to, and settled with its web bottoms supported on the web top projections of, inferior blocks, automatically bed jointing is attained quite uniform along a course and from course to course. At the same time, there are being produced elongated vertical wall cells and wall slots which are totally circumferentially closed at each course by the presence of the web projections and the mortar of the bed joints. Then when an appropriate vertical interval of the wall is completed, e.g., the height of each floor or at other suitable frequency, a grout or similar cementitious mix is pumped into or otherwise filled into all of the elongated vertical wall slots, providing simultaneously not only the bonding between endwise-abutting, i.e., successively adjacent, blocks of each course, but also the reinforcement and strengthening of the wall attendant upon presence even of each solid vertical core thus produced of mortar or fine aggregate concrete. Further, steel rod reinforcement may be incorporated even in some or all of these filled vertical wall slots.

The saving, of the labor and the usual dropping waste in applying mortar endwise to blocks, thus achieved by the elimination of the usual head joint formation should be immediately obvious.

Moreover, as hereinafter explained, for the course completing each floor, or oftener if required, beam-forming "distribution blocks" or "head blocks" are used. These are substantially modularly identical to the other blocks, excepting that the cells, i.e., the larger cavities thereof having integral bottom walls forming pockets to contain mortar, and the web tops have pairs of deep notches receiving horizontal reinforcing bars or rods at a depth to be embedded in a horizontal fill of mortar along the beam block course. The horizontal bars thus located in the notches also advantageously help to maintain vertical reinforcing rods centered in respective elongated wall slot spaces. The vertical rods for the number of wall slots desired to be reinforced are emplaced and located after completion of each story-high wall section erection. Then, grout mortar or concrete is poured or pumped at the beam block course, as a distribution course, to fill the pockets to embed horizontal rods and at the same time filling the elongated vertical wall slots. An integrally poured reinforced concrete frame within the wall results comprised of vertical columns and effect horizontal beams, a result not broadly new but attained by a single pouring operation for each second.

With one conventional practice the mason lays up the wall in half-story heights and at each erects a continuous horizontal bond beam including horizontal reinforcing bars in solid-bottom bond beam blocks, pours the beam, then splices the next vertical rods to those of the work completed, and then resumes the wall erection. In another practice reinforcing wire is emplaced at each course embedded in the bed joint mortar. By the present invention, vertical bars are emplaced for each entire completed story height and the entire story is poured at one time. Also the steel reinforcing at the distribution course equals and replaces the conventional wire at each course.

In quite high buildings, for the lower floors it may be preferable to use a fully reinforced block wall, using blocks and reinforcement rods, horizontal and vertical, as described in said Ivany U.S. Pat. No. 3,222,830; while in the upper floors and intermediate floors, or in lower buildings, the present block and construction is used, with increased percentages of the slots being also reinforced, as considered from the top down in the finished structure.

The general object of the present invention is then to provide an improved building wall construction comprised of molded hollow concrete blocks and the like, and an improved construction method.

A further object is to provide an improved block module and method of using the same in wall construction.

A still further object is the provision of a hollow building block module, whereby the usual head joint mortar application is eliminated, while attaining a strong improved end-to-end abutment bonding between successive blocks or modules in a course.

A still further object is the provision of a module and cooperative reinforcing means of improved character.

Other objects and advantages will appear from the following description and the drawings wherein.

Figure 1:
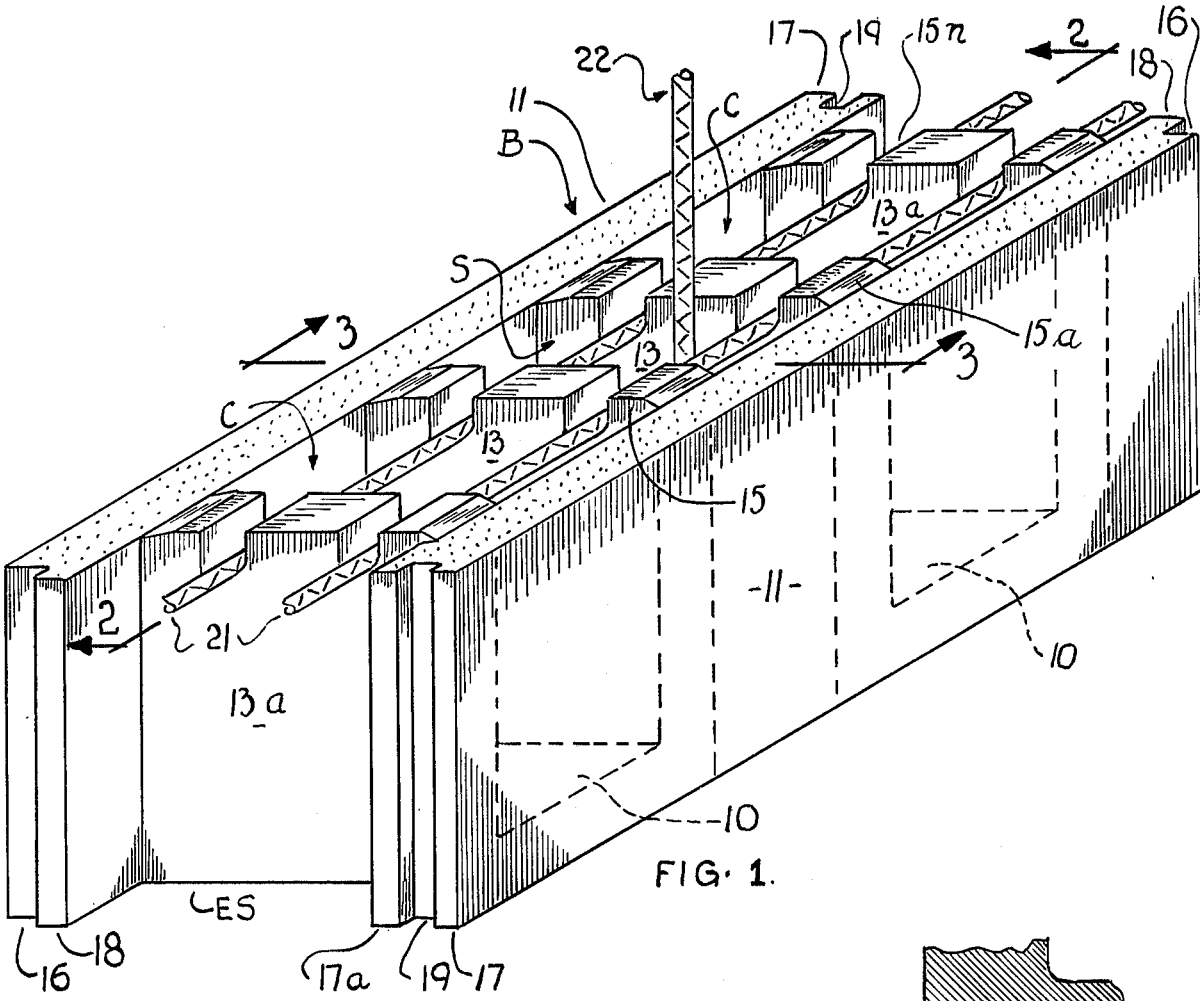
FIG. 1 is a perspective view of a hollow building block module, a distribution block, of the present invention, and showing the relative position of steel reinforcement.
Figure 3:
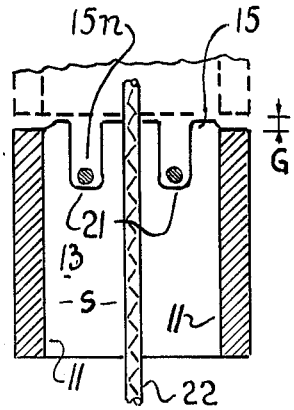
FIG. 3 is a vertical section at 3—3 in FIG. 1.

In FIG. 1 there is shown a three-cavity hollow building block B molded or cast of cement or the like by known methods and equipment, and embodying the module aspects of, and suitable for building wall structures and construction methods in accordance with, the present invention. The positions, relative to the block and to each other, of horizontal and vertical steel reinforcing rods or bars 21, 22 is indicated also in FIG. 1. Further details of the block form may be gathered especially from FIGS. 2, 3 and 3, as hereinafter described. The terms "vertical" and "horizontal" will be used in description of the block as convenient references based upon normal block disposition in a building structure.

The block B is comprised of two similar parallel longitudinal vertical side walls, 11, 11 (generally here termed "side walls ") rectangular in elevation and joined by interrupted, web-joining bottom wall portions 10, 10 closing the bottoms of cells C and also by four parallel, vertical, like transverse walls, or webs 13, 13, 13*a*, 13*a*, each having a pair of deep top notches 15*n*, 15*n* to a depth for locating horizontal reinforcing bars 21 well below the coplanar top margins of the side walls. Two of these webs 13, 13, at the central region have opposed faces equally spaced from the transverse vertical central plane of the block; the other two, 13*a*, 13*a*, being similarly spaced in from the respective block ends. Each web has a top projection 15 with lateral ends 15a sloped or beveled, the height of which projection, above the coplanar top edges of walls 11, establishes the gap G desired for the horizontal bed joint between blocks of successive courses.

Though only the outer faces 11a of the walls 11 on the one hand and the major end surfaces 16–17, 16–17 of the respective walls 11 on the other, are in strict sense vertical and parallel, since it is to be understood that for molding purposes some draft is present on the web faces and interior surfaces 11a of walls 11 and that there are corner fillets between webs and walls, all of these are here termed vertical and, among them, those of similar orientation then termed parallel unless otherwise specifically stated.

Figure 2:
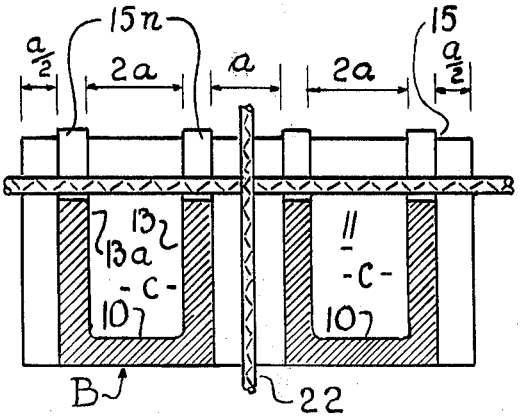
FIG. 2 is a vertical section at 2—2 in FIG. 1.

The spacing of the webs is so proportioned that the dimensions longitudinal of the block for the end recesses, the narrow central cavities, and the two larger cavities on either side of the central cavity (here termed slot or "middle slot S", "cells C", and "half-slots" or "end slots" ES respectively) as measured longitudinally of the block between opposed walls or web faces of the cavities or a recess web wall and main end surfaces 16, 17 of the longitudinal side wall ends, are in the ratio X:Y:2X:Y:X, here shown as through 1:4:2:4:1. That is, with the narrow dimension of the central or middle slot designated *a* between the opposed faces of the webs 13, 13, the corresponding dimension for each of the cells is 2*a* and for the end recesses or half-slots *a*/2, as indicated in FIG. 2. In a block of nominal 16 inch length, the dimension *a* is aptly 2 inches, with the webs 1 inch thick.

Over the entire height of the end walls or main faces 16, 17 of each wall 11, there extends respectively a vertical tongue 18 or groove 19 of complementary cross sectional shape; complementary in the sense that the tongue is receivable in the groove; further with a groove occurring on one wall and a tongue on the other wall at each block end, resulting in two-fold rotational symmetry about the module's vertical central axis, so that a block may be picked up upright but otherwise randomly, and never has to be turned end-for-end for proper orientation to place it with the principal end faces 17–16 in abutting relation to the similar faces 17–16 of the preceding block in a course. A block of this type is easily handled in a nominal 16 inch length, where typically the side walls are 15-15/16 by 7⅝ by 1¼ inches thick, the block width 7⅝ inches and the web elevation ¼ inch, the bottoms, 1 inch.

Since the groove mouth width is typically half the thickness of the side wall, and begins one-third of the thickness in from the outer face, the side walls 11 preferably have at least the grooved ends thickened (see also FIG. 4 and FIG. 4A) by material added on the inside faces inward of slots 19 between the respective end web 13 and the end of the wall, as represented at a full thickening 17*a;* the addition corresponding to the transverse dimension of a projection of the web end bevel on a horizontal plane. The tongue 18 is similarly located on what would be the normal sidewall thickness or width on the end edge, the base of the outer sloped face (i.e., the outer oblique side) of the tonque occurring one-third in and (with the base of the tongue shape occupying the greater remaining part of that normal thickness), the tongue inner side or face in effect extended as surface 16*a*, running obliquely to the adjacent end web into a corner fillet. What would otherwise be a slight squared corner portion inward of the tongue is thus lost, diminishing somewhat the actual width of the tongue-bearing end edge surface. However, the tongue-bearing end can also be reinforced with a triangular sectioned vertical fill resulting by shifting the region of merging of the surface 16*a* with the web to a location corresponding to the horizontal spacing of top edge of the web bevel from the side wall.

Figure 4A:
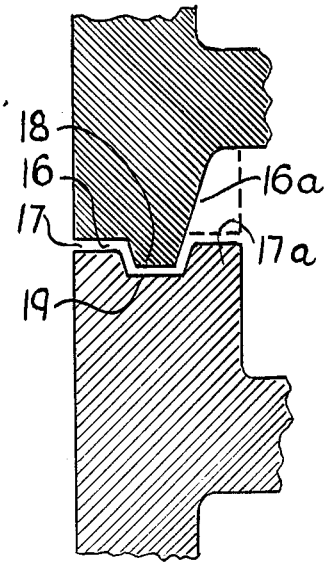
FIG. 4A is a joint detail.

FIG. 4A details the resultant tongue-and-groove engagement of two blocks. As the grooved block end edge, with groove walls complementary in angular disposition and spacing to the two sloped and end-flat surfaces of the tongue, has not merely a narrow inward end face portion representing the residual normal wall thickness but also the width addition of the thickening portion 17*a*, there is formed a wide shoulder extending an appreciable distance laterally inwardly beyond the opposed tongue location. Thus not only is there a strengthening of the grooved wall portions projecting beyond the endmost webs 13*a*, but also quite importantly, there results over the wall height, a grout-receiving triangular section recess inward of the region of tongue and groove engagement. Each such recess is readily filled with the wall slot filling grout, and furnishes an appreciable additional area of joint bonding for the grout particularly advantageously penetrating as it were between the abutting end wall portions parallel to the length of the block.

The distribution block form of FIG. 1 could be used throughout an entire wall, but needlessly so. Use of these rather is reserved to periodic distribution courses occurring at the top of each wall section corresponding to a floor or story height; while for the major remaining part of the wall, modularly similar blocks A are used. These, at times called "slot blocks", are identical to FIG. 1, except for omission of web notches 15*n* and of cell bottom walls 10.

Horizontal bars 21 are securely located in the bottoms of notches or grooves 15*n*, e.g. in the 16 inch block with notches 1½ inches deep, at a level below coplanar sidewall top margins to be embedded say below an inch or mortar, when the cell pockets are filled level. Even by themselves to some degree bars 21 center vertical bars 22; but a vertical reinforcement rod 22 may be maintained substantially centered relative to the slot walls by wiring it centered between rods 21.

Figure 4:
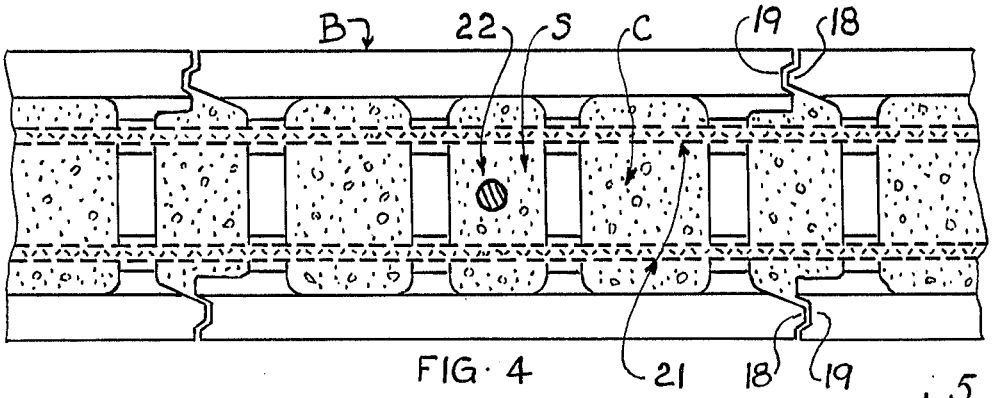
FIG. 4 is a fragmentary horizontal section, grout filled, through a portion of a wall constructed in accordance with the present invention and utilizing modules such as those of FIGS. 1–3, after filling of the block cavities, and the aligned wall slots at a distribution course.
Figure 5:
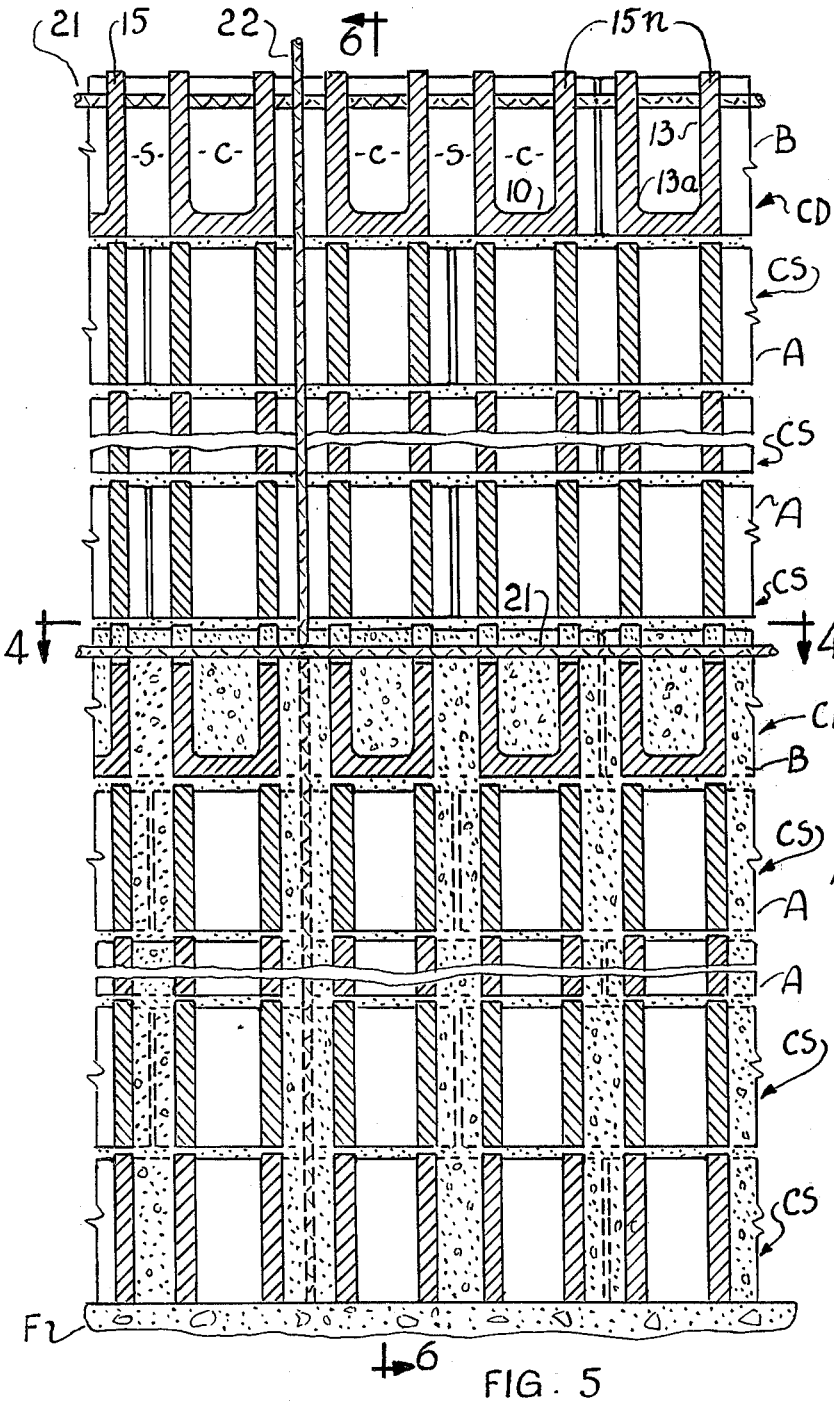
FIG. 5 is a fragmentary vertical section through a wall.
Figure 6:
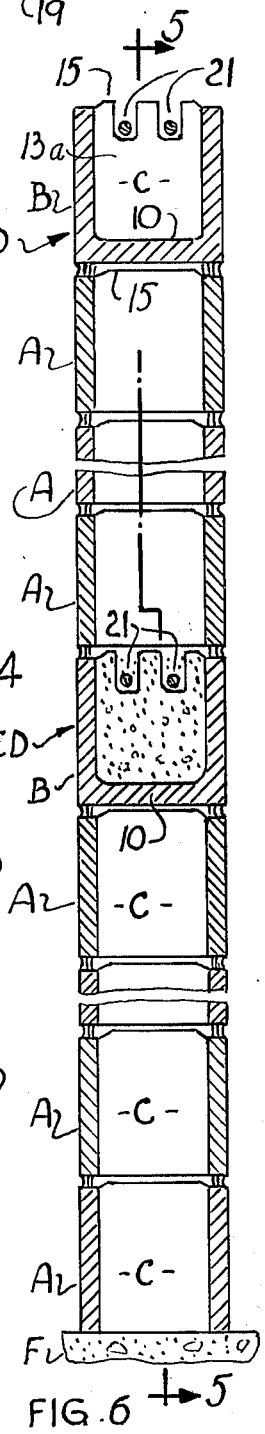
FIG. 6 is a vertical section as taken at 6—6 in FIG. 5.

From the above description and reference to FIGS. 4–6, the basic manner of use and avantage of the module is obvious.

Starting, of course, from one appropriate footing F (in FIG. 5), a given wall section is made up of the modules by laying down the mortar necessary for the bed joint as usual, but no head joint mortar is applied as each block of a course is positioned. The courses CS of slot blocks A and CD of distribution blocks B are similarly handled except as noted below. The courses are staggered, that is, vertical joints of one are centered over the central cavities or slots of the blocks in the course beneath.

The vertical tonguing and grooving 18, 19 aid the positioning of one block into another in the course being laid; and the web tongues or projections 15 on the inferior course establish the thickness of the bed joint as each block is settled in staggered position; thus easily affording smooth even wall faces, and joint uniformity. If added strength is required, a distribution course CD may be laid before a wall or story height is completed, with the horizontal bars 21 positioned therein and only the cell pockets mortar-filled to embed the bars 21.

As successive vertical sections of the wall are completed in selected suitable heights, the elongated vertical wall slots, resulting from alignment of alternating middle slots and joined abutting end- or half-slots, are filled with pumped in fine aggregate concrete, or mortar, grouting cement 26, the consistency of the mortar component, being suited to this end. The combination of web projections and the bed joint mortar already present confines the mortar effectively to the regions of intended use, that is, the wall slots into which pumped. This feature has the further advantage that one side wall may be slotted to provide a sound absorbing opening into one or both cells, hence the wall cells, as there is no grouting escape into the latter from the wall slots on filling. The mortar filling the pockets and the wall slots, of course, can pass through slots 15n, and in so doing contribute to horizontal continuity.

Though a larger volume of mortar is present in the vertical wall slots than in the usual mortared head joint, this represents no economic loss in view of the labor saved, the fact that there is no ineffective consumption of mortar (e.g., by droppings outside the wall, or loosely randomly falling into wall cavities) as in the normal head joint mortar application; and further by the attendant desirable increased strength achieved by the core of mortar in the vertical wall slot reaches. Since the wall slots are in any event filled, rodding 22 may there be used in up to all of the vertical wall slots to confer added strength.

I claim:

1. A method for constructing a building wall comprising the steps of:

providing like three-cavity molded hollow rectangular block modules of cement-like material each comprised of a pair of like parallel vertical longitudinal side walls joined by pairs of like, flat-topped transverse webs.

the side walls having coplanar horizontal top edges, coplanar horizontal bottom edges, and at the respective ends of the block, coplanar principal end faces or edges, the tops of the webs extending above the side wall edges in projections beveled at opposite ends toward the side wall top edges, and the bottoms of the webs coplanar with the side wall bottom edges thereby to define a bed joint space between successive courses of block modules laid with webs aligned, the opposite end edges of each side wall having respectively a tongue and a groove complementary thereto, said webs mutually spaced to define a narrow central slot cavity, with a larger cell cavity one each side thereof, and end recesses comprising respective half-slots forming a full slot size when the block modules are abutted endwise in a course;

laying block modules, abutting endwise without application of head joint mortar to individual blocks in courses, upon bed joint mortar applied to the top edges of block modules in underlying courses, the block modules in each course staggered to bring the abutments over the central slots of block modules in the underlying course, thereby to form vertically elongated wall slots;

periodically among said courses including a distribution block course whereof:

the said block module have bottom walls in the cell cavities to form mortar receiving pockets, and the web tops have paired downward, horizontal reinforcing bar receiving notches, reaching to a depth sufficiently below the side wall top edges for said bars to be embedded by mortar filling said pockets;

after laying up to courses to a distribution course at storyheight, emplacing horizontal bars in the notches of the distribution course blocks and vertical reinforcing bars in some selected wall slots, and filling the mortar pockets of the distribution course blocks and the vertical wall slot.

2. The method as described in claim 1, including the further step of:

including a further distribution course at less than storyheight; emplacing horizontal rods, also in said further distribution course; filling with grout only the pockets of the further said course, at the time of laying.

3. A three-cavity molded concrete building block, comprising:

two like parallel vertical longitudinal side walls rectangular in elevation and joined by four like vertical transverse webs, the opposite ends of each longitudinal sidewall respectively complementarily tongued and grooved vertically, the transverse webs each extending above the sidewall top margins in end-beveled projections; the block having two-fold rotational symmetry about a vertical center line, said webs having face-to-face spacing of X:Y:2X:4:X defining a slot-like narrow middle cavity, and adjacent thereto equal larger cavities as cells of at least slot size, and end recesses of half-slot sizes;

whereby with blocks staggered in successive courses, the webs thereof are vertically aligned, with the web bottoms bearing on inferior web projections to establish a uniform bed joint gap between courses and to provide vertically elongated wall cells and slots;

whereby circumferentially closed narrow vertical web slot spaces, arising, as the blocks are layed up, from aligned alternating full slots and slots formed by adjacent half-slots of abutting blocks, are fillable with grout to afford head joint bonding;

the said cells being closed by bottom walls integrally formed with the cell-bounding side walls and webs, thereby to form upwardly open mortar-receiving pockets, and the top ends of said webs each having pairs of downward, horizontal bar receiving notches, reaching to a level sufficiently below the side wall top edges that mortar filling said pockets embeds bars seated in the notch bottoms.

4. A building block as described in claim 3, wherein:

said side walls have coplanar top edges and bottom edges coplanar with the bottom edges of the webs; and on the two end edges at each end coplanar principal end edge surfaces.

5. A building block as described in claim 3, wherein:

the projecting tops of the transverse webs are beveled at opposite ends; and the groove bearing ends of said side walls are thickened toward the interior of each said end recess up to the adjacent web.

6. A building block as described in claim 3, wherein:

each side wall at its groove bearing end is strengthened over its entire vertical extent outward of the adjacent endmost web by a general inward thickening beyond the normal side wall thickness, and the inside face of each tongue-bearing end is defined by a surface extending from the base of a tongue inner side face up to, and obliquely disposed relative to the adjacent web, whereby at each region of tongue and groove engagement of endwise abutting blocks there is provided a region readily entered by grout filled into a respective wall cell to form a grout bonding between the abutted wall end portions.

7. A building wall structure comprising, vertically successive staggered courses of modularly-similar blocks, including a distribution course constituted of distribution blocks such as that described in claim 3, all said blocks being in end-to-end, tongue-and-groove interlocking, abutting relation to horizontally adjacent blocks and with mortared bed joints between said courses;

horizontal reenforcing bars in the distribution course block notches, and embedded in mortar in the distribution course block pockets;

vertical reenforcing bars in at least some wall slots; and grouting filled into the vertical wall slots providing heading bonding between adjacent blocks and elongated vertical reenforcing cores in the wall.

8. A building wall structure produced by the method described in claim 1.

9. A block as described in claim 3, wherein said spacing has the relation of 1:4:2:4:1.

* * * * *